US005538251A

United States Patent [19]

Harper

[11] Patent Number: 5,538,251

[45] Date of Patent: Jul. 23, 1996

[54] TRAINING APPARATUS FOR DEVELOPING A GOLF SWING

[76] Inventor: Clint Harper, Route 1, Box 1434, Paul, Id. 83347

[21] Appl. No.: 387,105

[22] Filed: Feb. 10, 1995

[51] Int. Cl.[6] ..... A63B 69/36

[52] U.S. Cl. ..... 473/229; 473/409

[58] Field of Search ..... 273/191 R, 186.1, 273/186.2

[56] References Cited

U.S. PATENT DOCUMENTS

| | | | |
|---|---|---|---|
| 3,400,933 | 9/1968 | Heiser | 273/196.2 |
| 3,604,712 | 9/1971 | Prior | 273/186.1 |
| 4,261,573 | 4/1981 | Richards | 273/191 R |
| 4,486,020 | 12/1984 | Kane et al. | 273/191 R |
| 4,580,786 | 4/1986 | Shipley | 273/191 R |
| 4,653,757 | 3/1987 | Wilkinson | 273/191 R |
| 4,815,743 | 3/1989 | Meeker et al. | 273/191 R X |
| 5,005,836 | 4/1991 | Nelson | 273/191 R |
| 5,026,065 | 6/1991 | Bellagamba | 273/191 A |
| 5,050,874 | 9/1991 | Fitch | 273/191 R X |
| 5,069,456 | 12/1991 | Bellagamba | 273/183 E |
| 5,139,264 | 8/1992 | Wootten | 273/191 R |
| 5,188,367 | 2/1993 | Gipe et al. | 273/191 R |
| 5,221,089 | 6/1993 | Barrett | 273/187.2 |

*Primary Examiner*—William H. Grieb
*Attorney, Agent, or Firm*—Trask, Britt & Rossa

[57] ABSTRACT

A golf swing training apparatus is disclosed which is portable and positionable both indoors and outdoors. The golf swing training apparatus provides longitudinally adjustable vertical support structure, rotation training structure interconnected between the vertical support structure and a golf club, and a rotatable club attachment collar which secures the shaft of the club to the rotation training structure in a manner which allows the club to be swung through a perfect swing plane. The adjustability of the vertical support structure permits modification of the device to suit the height and body structure of the individual user so that an optimal swing plane may be achieved and practiced consistently. The adjustable length of the rotation training structure trains the user to rotate the arms and hips in a manner to keep the club in the proper swing plane while permitting the user to move naturally and unencumbered.

20 Claims, 5 Drawing Sheets

TRAINING APPARATUS FOR DEVELOPING A GOLF SWING

BACKGROUND

1. Field of the Invention

This invention relates to the development of an optimal golf swing, and specifically relates to a device which trains a person to adopt an optimal stance and body rotation for practicing a golf swing.

2. Description of Related Art

Many devices have been designed for developing a correct golf swing. Many of those devices recognize that the difficulty of developing a perfect golf swing resides in the fact that few practitioners are able to maintain a study and consistent swing through a plane which defines the optimal swing plane. Some of those devices attempt to address that problem, and vary in their approach to maintaining a perfect stance and swing.

A perfect golf swing requires the practitioner to stand with the club shaft at an angle to his body so that the bottom surface of the head of the club is square with the ground. As the practitioner brings both arms and the club back, and then reverses the swing rotation so that the club head strikes the ball and the arms and club follow through, the head of the club must traverse the air in a circle, maintaining the head of the club on a consistent rotation though a circular plane. In an unperfected swing, the shaft of the club may wobble, or the arms and body may bend improperly so that the head of the club does not move in a consistent swing plane. As a result, the club head is not square with the ground as the club rotates downwardly to hit the ball. An imperfect swing may either result in the ball not being hit, or in producing a divot or in hitting the ball with insufficient or improper angle to prowl the ball upwardly on the proper trajectory.

Examples of swing practice devices and methods are disclosed in U.S. Pat. No. 3,400,933 to Heiser, issued Sep. 10, 1968 and U.S. Pat. No. 4,486,020 to Kane, et al., issued Dec. 4, 1984. In prior golf swing practice devices, including the aforementioned, the perfect swing plane may not be achieved because the device is either too flexible or too inflexible in maintaining the golf club or practice club in an arcuate plane. If the practice device is too flexible, the device will not provide sufficient rigidity to the swing rotation and the user's arms and/or club will wobble. If the device is too inflexible, the rigidity of the device will not allow the practitioner's arms or body to move in a natural way consistent with that individual's body structure and the person cannot rotate his hips and body in the necessary way to strike the ball.

In addition, most devices are of a standard construction and provide no means for adjusting the device to the requirements, particularly the height, of the user. That is, when a person of short stature uses the same, unadjustable device that a person of tall stature uses, the shorter person will be forced to adopt a stance improperly or uncomfortably distanced from the ball and will not achieve a rotation in the perfect swing plane. At the same time, a very tall person may be forced to stand too close to the ball due to unadjustable construction of the device and he too may not achieve rotation in the perfect swing plane. In addition to the foregoing problems with prior golf swing practice devices, few, if any, devices provide means for preventing laying-off of the club as a part of developing the perfect golf swing.

Thus, it would be advantageous to provide a golf swing training device which has sufficient adjustability, and hence flexibility to produce an optimal rotation of the user's arms and body while compensating for natural positioning of the practitioner's body through the swing cycle. It would be advantageous to provide a golf swing training device which is adjustable in height so that the device may be adjusted to accommodate the body height of the user. It would also be advantageous to provide a golf swing device which is structured to prevent laying-off of the club in further development of the optimal swing. It would also be advantageous to provide a golf swing device which is easily adapted to indoor use as well as outdoor use.

SUMMARY OF THE INVENTION

In accordance with the present invention, apparatus for developing a consistent and correct golf swing includes a longitudinally adjustable vertical support structure, a longitudinally adjustable rotation training structure interconnected between the vertical support structure and a golf club, and a rotatable club attachment collar for securing the club to the support structure and which prevents laying-off of the club. The invention further includes horizontal guidance structure for assisting the user in assuming a proper stance in addressing the ball, and a wall bracket attachment which allows the vertical support structure to be used indoors or on a vertical wall support.

The longitudinally adjustable vertical support structure of the invention generally comprises a tubular or rod-like post. The vertical support structure may comprise a first member and a second member which is telescopically and slidably positioned relative to the first member. The first member is structured to be anchored to another structure for stably positioning the support structure in a vertical orientation. The first member may preferably be structured with means which permit the support structure to be staked in the ground for outdoor use. The first member also may be structured to adaptably attach to a base member for positioning on a hard surface, such as concrete. The first member is also adapted for placement within a bracket, which is in turn adapted for attachment to a vertical support surface, such as a wall, so that the golf swing training apparatus may be used indoors.

The second member of the vertical support structure is slidably positioned relative to the first member and telescopes relative thereto, providing longitudinal adjustment to the vertical support structure. A locking means is positioned between the first member and second member to secure the two members in a selected position relative to each other. In operation, the locking means may be loosened or disengaged, the two members may then be slid together or apart to lengthen or shorten the overall length of the vertical support structure, and then the locking means is tightened or engaged to maintain the first and second member in their selected positions relative to each other. The second member may include indicator marks on the external surface thereof to aid the user in adjusting the vertical support structure to a consistent height in subsequent uses.

A length-adjustable rotation training structure, having a first end and a second end, is attached by its first end to the second member of the vertical support structure in a manner which permits the rotation training structure to move or rotate relative to the vertical support structure. The adjustable rotation training structure is comprised of an elongated rod or tube which extends between the vertical support structure and the golf club or training club held by the user.

The rotation training structure includes an automatic length adjusting means which permits the length of the rod to temporarily shorten responsive to pressure exerted on the longitudinal axis or length of the rod resulting from the user's downward rotation of the arms and body following the backswing.

The automatic length adjusting means is not so responsive to pressure that the rod of the rotation training structure shortens and lengthens uncontrollably to the detriment of the swing. However, the automatic length adjusting means is sufficiently responsive to the slight pressure exerted by the movement of the user's body as the hips rotate during the downswing so that the rod will shorten slightly to allow the user's arms and hips to move naturally through the downswing while maintaining the club rotation substantially within the perfect swing plane. Absent a length adjusting means as disclosed herein, the relatively inflexible rod of the rotation training structure would cause the user's arms to stiffen, buckle and/or bind in an unnatural manner and the arms or grip of the club will be forced into the user's rotating hips. As a result, the club will be forced out of the swing plane and/or will be forced toward the ground, thereby causing the club head to strike the ground. The automatic length adjusting means may comprise a spring positioned along the length of the rod which compresses upon application of pressure on the rod. Any other suitable means of temporarily reducing the length of the rotation training structure may be used. The rod of the rotation training structure may be made of any inflexible material or slightly flexible material, but should be substantially rigid along the longitudinal axis thereof.

The second end of the rotation training structure is attachable to the shaft of a golf club by means which permit the club to rotate relative to the rotation training structure. For example, a rotatable club attachment collar may be secured to the second end of the rotation training structure and the collar secured about the shaft of a golf club. The rotatable club attachment collar may include stop means which impact a portion of the rotation training structure when the club is at the top of a swing to prevent laying-off of the club. By "laying-off" is meant that the club is not pointing down or toward the target. Laying-off the club causes the club head to shift so that the ball is not hit properly. Alternatively, the rotatable club attachment collar may be configured without the stop means.

The golf swing training device of the present invention also includes a horizontal guidance structure positionable near the bottom of the vertical support structure which assists the user in correct placement of his or her feet in relationship to the ball, the club and the device. The horizontal guidance structure may be optionally used with the golf swing training device. The present invention also includes a bracket which is structured to hold the vertical support structure therein and which is securable to a vertical support surface. With the bracket attached to a vertical surface, such as a wall, the golf swing training device may be used indoors. The bracket may also be attached to an outer wall or to a fence, thereby permitting use of the golf swing device outdoors where no grass or dirt exists for staking the device in the ground.

BRIEF DESCRIPTION OF THE DRAWINGS

In the drawings, which illustrate what is currently regarded as the best mode for carrying out the invention.

FIG. 8 is a time-lapse photograph taken in the dark with the head of a golf club illuminated to illustrate the movement of the golf club head through the entirety of a swing, including the backswing to the follow through.

DETAILED DESCRIPTION OF THE ILLUSTRATED EMBODIMENTS

Figure 1:
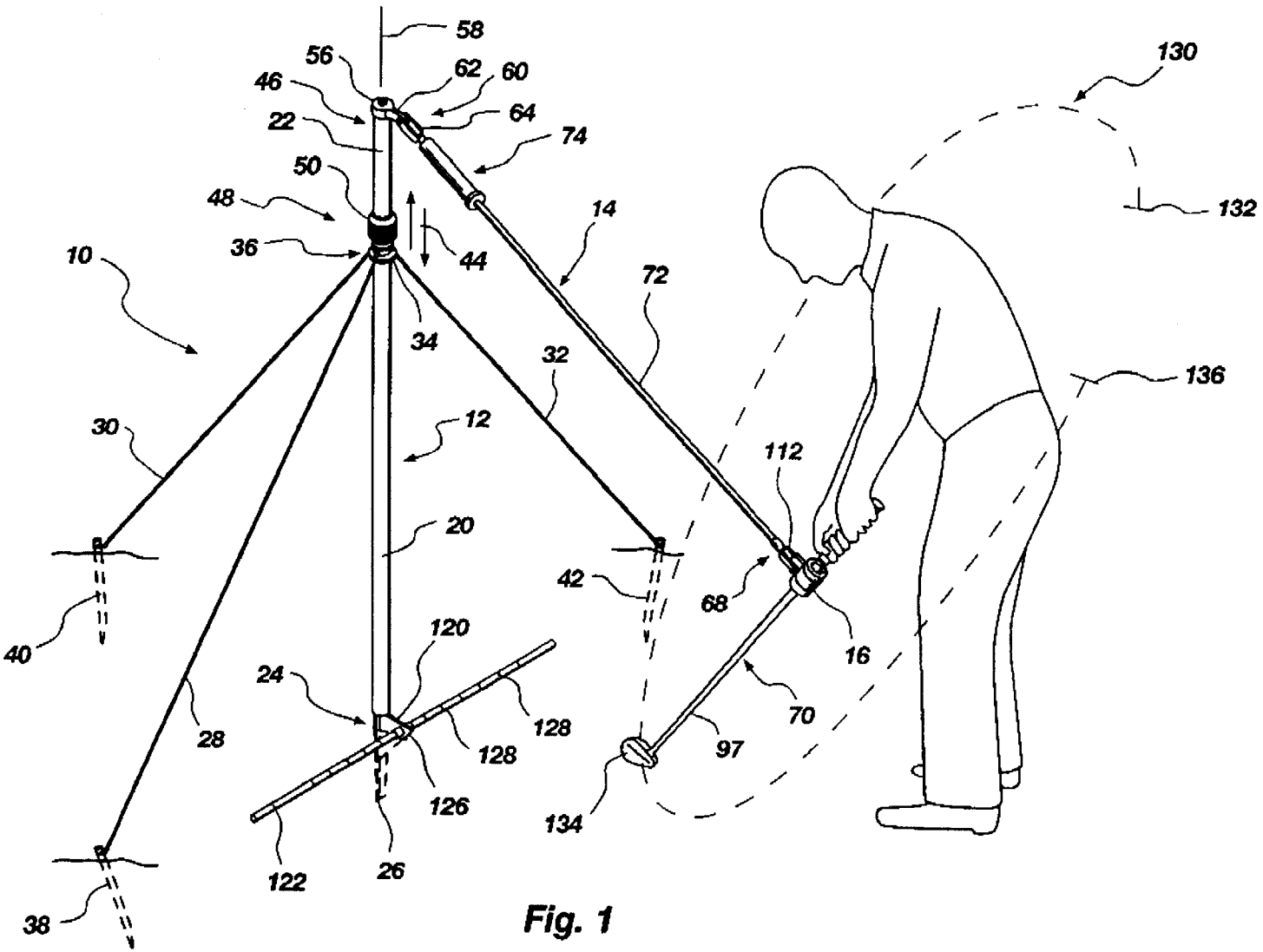
FIG. 1 is a perspective view illustrating the structure and use of the invention.

FIG. 1 illustrates the general structure of the golf swing training device 10 of the present invention and depicts a method of using the device. The golf swing training device 10 generally comprises a longitudinally adjustable vertical support structure 12, a longitudinally adjustable rotation training structure 14 and a rotatable club attachment collar 16.

The vertical support structure 12 comprises a first member 20 and a second member 22 which are coaxially aligned and slidably adjustable relative to each other. The first member 20 and second member 22 may preferably be tubular in construction and slidably positioned one within the other in a telescoping fashion. As shown in FIG. 1, the second member 22 may be positioned within the first member 20. The first member 20 has a first end 24 which is structured for securement to a support surface. As shown, the first member 20 may be constructed with a stake 26 at the first end 24 thereof permitting the vertical support structure 12 to be positioned in the ground.

To stabilize the vertical support structure 12, three or more anchoring lines 28, 30, 32 may be secured between the vertical support structure 12 and the ground. More specifically, the anchoring lines 28, 30, 32 may be attached to the first member 20 of the vertical support structure 12 by securely threading one end of each anchoring line 28, 30, 32 through an annular collar 34 encircling the upper end 36 of the first member 20 (See FIG. 5). The other end of each anchoring line 28, 30, 32 may be secured to a stake 38, 40, 42 which is positionable in the ground. Alternatively, the vertical support structure 12 may be secured to a horizontal base, (not shown) which is positionable on the ground or floor.

Figure 5:
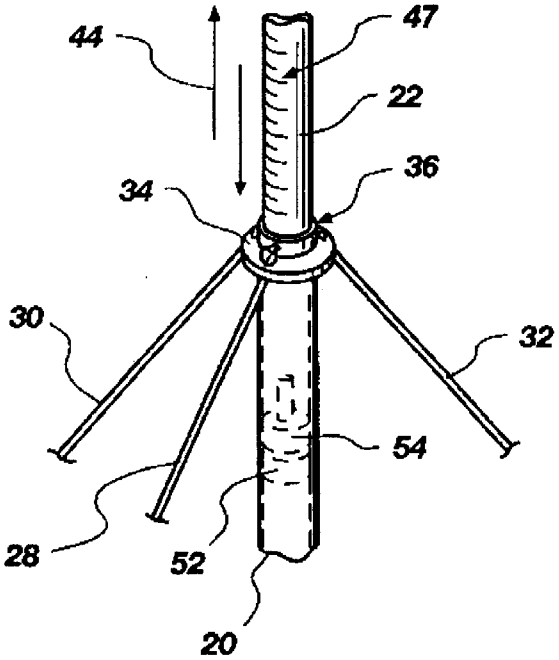
FIG. 5 is an enlarged view of the vertical support structure illustrating a securement means for vertical adjustment of the vertical support structure.

The second member 22 may be slidably disposed within the upper end 36 of the first member 20, thereby providing longitudinal adjustment of the vertical support structure in the direction of arrows 44 (FIGS. 1 and 5). Longitudinal adjustment (i.e., vertical adjustment) of the vertical support structure 12 allows the device to be set at a height appropriate to the user. Generally, the top 46 of the vertical support structure 12 should be adjusted, or raised in height, to a height where the golf club will be parallel to the ground when the club is at the apex of the swing plane (extended rotation to full backswing). The second member 22 may be constructed with indicator marks 47 (FIG. 5) to assist the user in establishing an appropriate height for the vertical support structure 12 and returning to that height in subsequent use of the device. It can be seen that the construction of the present invention provides the advantage of being adjustable for use by any number of different people because the device can be customized to each individual's body height and type, as discussed further below.

Securement means 48 are associated with the vertical support structure 12 to maintain the vertical support structure 12 at a selected vertical height. As shown in FIG. 1, the securement means 48 may comprise a threaded ring 50 which is positioned at the upper end 36 of the first member 20 and encircles the second member 22. The threaded ring 50 may be turned in one direction to loosen the friction contact which the threaded ring 50 has with the second member 22, and may be tightened again to increase the friction contact of the ring 50 with the second member 22 after the second member 22 has been moved to a desired height. Alternative means for providing securement means are available, such as an eccentric friction fit member, illustrated in FIG. 5, positioned within the tubular lumen of the first member 20 and second member 22 which, when rotated in the appropriate direction, causes a first disc 52 to tighten against the inner lumen of the second member 22 and second disc 54, connected to the first disc 52, to tighten against the inner lumen of the first member 20. Other securement means may be used such as apertures formed in the wall of the second member 22 into which a pin may be placed which impacts against the upper end 36 of the first member 20.

Figure 2:
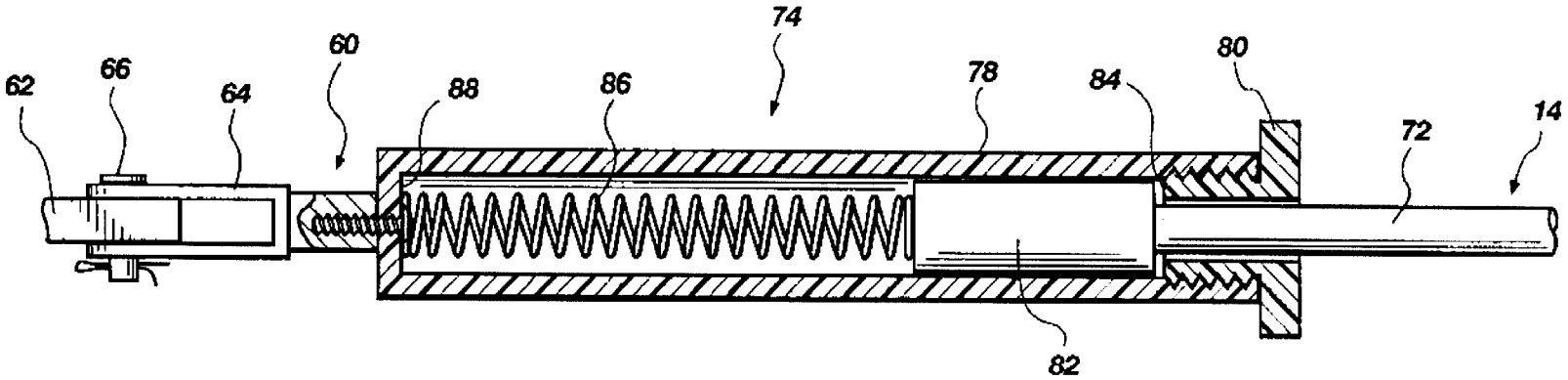
FIG. 2 is an enlarged view in cross section of the automatic length adjusting means associated with the rotation training structure.

The top 46 of the vertical support structure 12 is constructed with a rotatable cap member 56 which is rotatable about the longitudinal axis 58 of the vertical support structure 12. The rotatable cap member 56 is structured to retain a first end 60 of the rotation training structure 14 in pivotal articulation with the vertical support structure 20. For example, as shown in FIG. 1 and more clearly in FIG. 2, the rotatable cap member 56 may be constructed with a projecting flange 62 which is sized to fit within a U-bracket 64 connected at the first end 60 of the rotation training structure 14. The flange 62 and U-bracket 64 are secured together and articulate with each other about a pivot pin 66. The second end 68 of the rotation training structure 14 is securable to a golf club 70, as explained further hereinafter.

The rotation training structure 14 includes an elongated rod member 72 which extends generally between the vertical support structure 12 and the golf club 70. An automatic length adjusting means 74 is associated with the rotation training structure 14 to provide some degree of longitudinal movement of the rotation training structure 14 during the swing cycle. An exemplar mechanism for providing such longitudinal movement is illustrated more clearly in FIG. 2.

The mechanism of the automatic length adjusting means 74 includes a hollow housing 78 which is secured at one end to the U-bracket 64. The other end of the housing 78 is formed with a threaded, flanged end cap 80 which is removable from the end of the housing 78. The end cap 80 encircles the elongated rod member 72 below a plunger means 82 which has a greater circumference than the elongated rod 72. The plunger means 82 is sized in circumference to fit slidably within the hollow housing 78 and to engage an inner edge 84 of the end cap 80, thereby preventing withdrawal of the plunger means 82 from the housing 78. The plunger means 82 is capable of rotating within the end cap 80 and moving longitudinally within the hollow housing 78. A spring 86 is disposed within the hollow housing 78 and is biased between the plunger means 82 and the opposing inner end 88 of the housing 78. As explained further below, when pressure is applied longitudinally to the rotation training structure 14, as when the club is swinging downward from the backswing, the elongated rod 72 will urge the plunger means 82 within the hollow housing 78, thereby compressing the spring 86 and allowing the length of the rotation training structure 14, as measured between the vertical support structure 12 and the rotatable club attachment collar 16, to be decreased temporarily.

Figure 4:
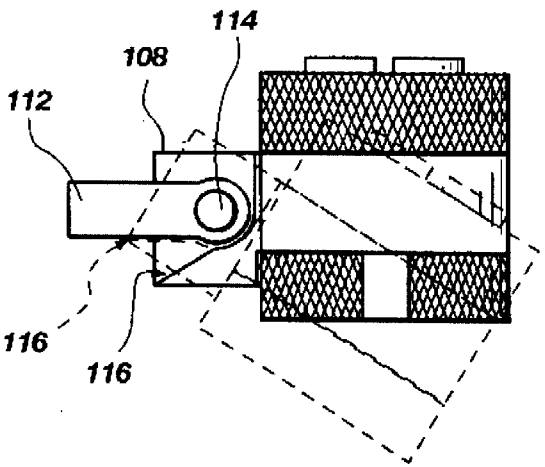
FIG. 4 is a view in elevation and in partial phantom illustrating multiple positioning of the rotatable collar to prevent laying-off of the club.
Figure 3:
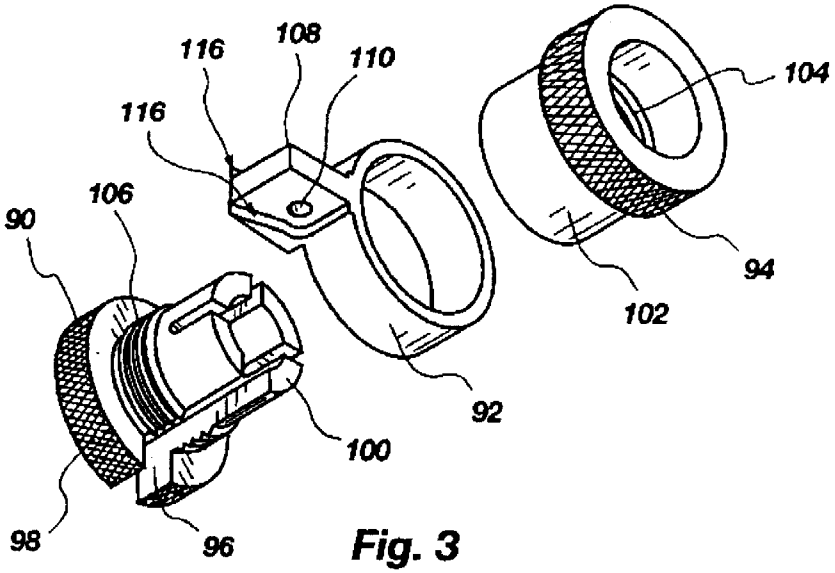
FIG. 3 is an exploded perspective view of the rotatable golf club collar.

The rotation training structure 14 is attached to a golf club 70 by means of rotatably articulating means such as the rotatable club attachment collar 16 shown in FIGS. 1, 3 and 4. As best seen in FIG. 3, the rotatable club attachment collar 16 comprises three interlocking members: an expandable yoke 90, a rotatable ring 92 and a securement nut 94. The expandable yoke 90 is constructed with split 96 through the length thereof which permits the yoke 90 to slightly expand as it is urged over the shaft 97 of the golf club (not shown). The expandable yoke 90 is positioned over the club shaft 97 so that the flange 98 thereof is positioned toward the head of the club and the neck 100 is positioned toward the handle of the club. The rotatable ring 92 is then passed over the handle of the club (not shown) and is positioned to encircle tile neck 100 of the yoke 90. The securement nut 94 is then passed over the handle of the club. The barrel 102 of the securement nut 94 is sized to fit easily within the rotatable ring 92, and the threaded interior 104 of the securement nut 94 is threadably engaged with the threads 106 of the expandable yoke 90. FIG. 4 illustrates the three elements of the rotatable club attachment collar 16 conjoined.

When secured together, the rotatable ring 92 is able to rotate freely about the barrel 102 of the securement nut 94. The rotatable ring 92 is formed with an extending flange 108 having a hole 110 formed wherein. As seen more clearly in FIG. 4, the extending flange 108 is engaged with another U-bracket 112 which is connected to the end of the elongated rod 72 (see FIG. 1), and the U-bracket 112 and extending flange 108 are secured together with a pivot pin 114 borne through hole 110. The pivot pin 114 permits the rotatable club attachment collar 16 to articulate with and rotate relative to the rotation training structure 14. The extending flange 108 of the rotatable ring 92 is structured with a lip 116 on either side of the extending flange 108. The U-bracket 112 is sized to receive the portion of the extending flange 108 between the lip portions 116, but the U-bracket 112 will impact against the lip portion 116 of the extending flange 108 when the club is at the top of the swing and the club is at the point of being laid-off. The impact of the lip 116 against the U-bracket 112 at extended rotation is illustrated in phantom in FIG.4.

In operation, the user should first position the vertical support structure 12 in the ground by pressing down on the ground bracket 120 (shown in FIG. 1) with a foot. Next, the three anchor lines 38, 40, 42 should be staked out a distance from the vertical support structure 12 to stabilize the device in a vertical position. Alternatively, the vertical support structure 12 may be secured to a base or stand (not shown). Once staked in the ground as illustrated in FIG. 1, the user may insert a horizontal guidance structure 122 through, for example, a hole 126 formed in the ground bracket 120. The guidance structure 122 is then perpendicular to the longitudinal axis 58 of the vertical support structure 12. The user then positions himself facing the device 10 and positions his feet perpendicular to the guidance structure 122. Markings 128 on the guidance structure may be used to position the feet an appropriate distance apart.

With the user standing facing the device 10, he should position his arms in a normal backswing position to determine the height at which the rotation training structure 14 is parallel to the ground at the apex of the swing. The vertical support structure 12 should then be adjusted in longitudinal length (i.e., height) until the second member 22 of the vertical support structure is at a sufficient height to maintain the rotation training structure 14 parallel to the ground at the top of the swing. The user is then ready to begin practice. With the feet perpendicular to the guidance structure, the user may then begin to swing. As the user swings back, the rotation training structure 14 pivots relative to the top 46 of the vertical support structure 12 and sweeps out an arcuate path. The rotation training structure 14 will maintain the club on a consistent swing plane 130, shown in phantom in FIG. 1.

Figure 7:
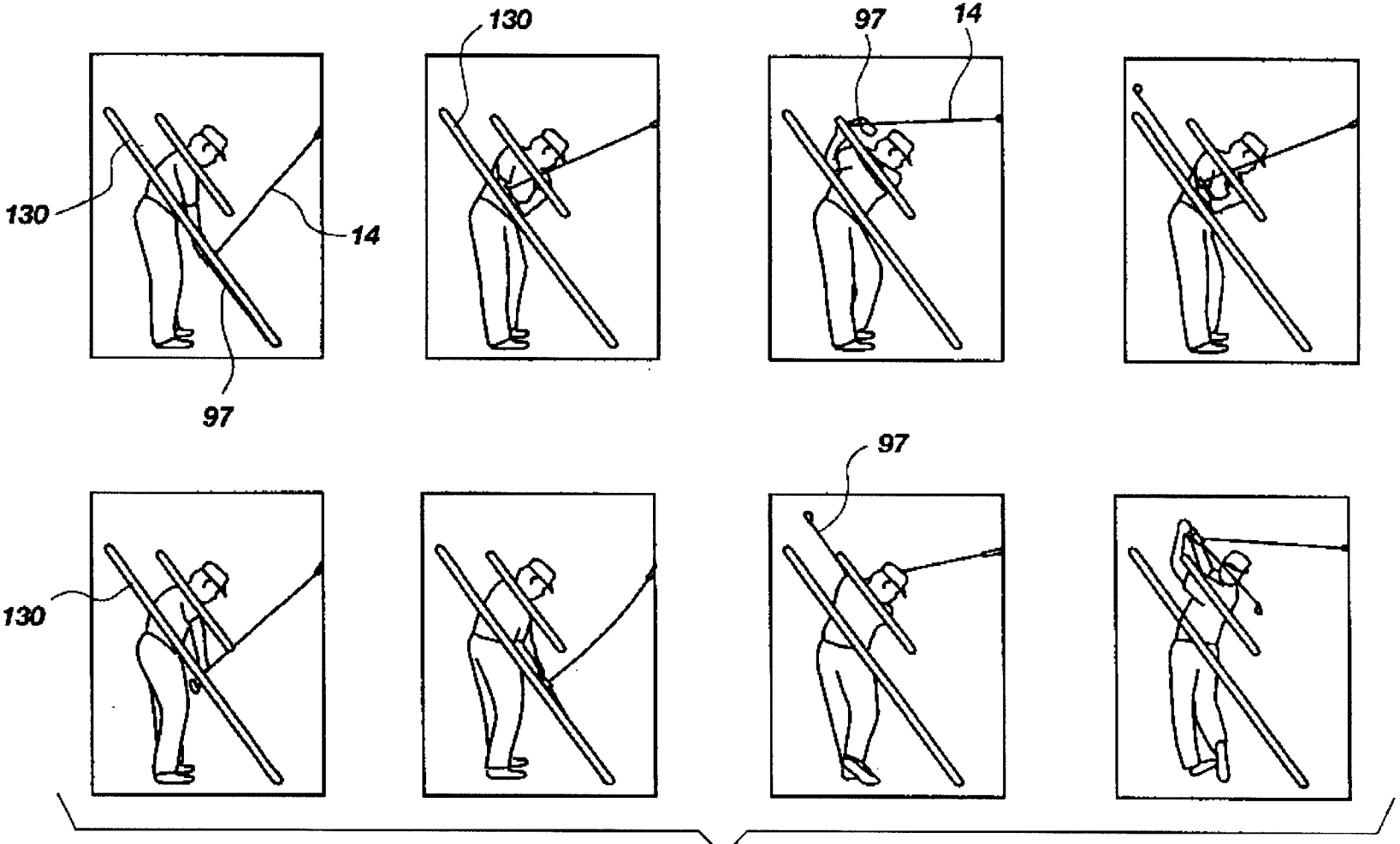
FIG. 7 is a series of eight photographic representations of a golf swing, from the backswing to the follow through, illustrating the movement of the golf club along a swing plane and the relative position of the golfer's shoulders throughout the entire swing.

There is no single perfect swing plane. The perfect swing plane is defined by the angle of the shaft 97 of the golf club when the head of the club is correctly addressing the ball and when it is parallel to the ground, as illustrated in FIG. 7. Depending on the height or the subjective comfort of the individual golfer, however, the angle of the shaft 97 may be more vertical or more horizontal relative to the ground. It has been demonstrated by computer graphic techniques that the most accurate golf swing takes place consistently within that single plane as described. Movement of the club out of the swing plane anywhere along the virtual 360° rotation of the club about the golfer's body will lead to less than a proficient contact with the ball.

Figure 8:
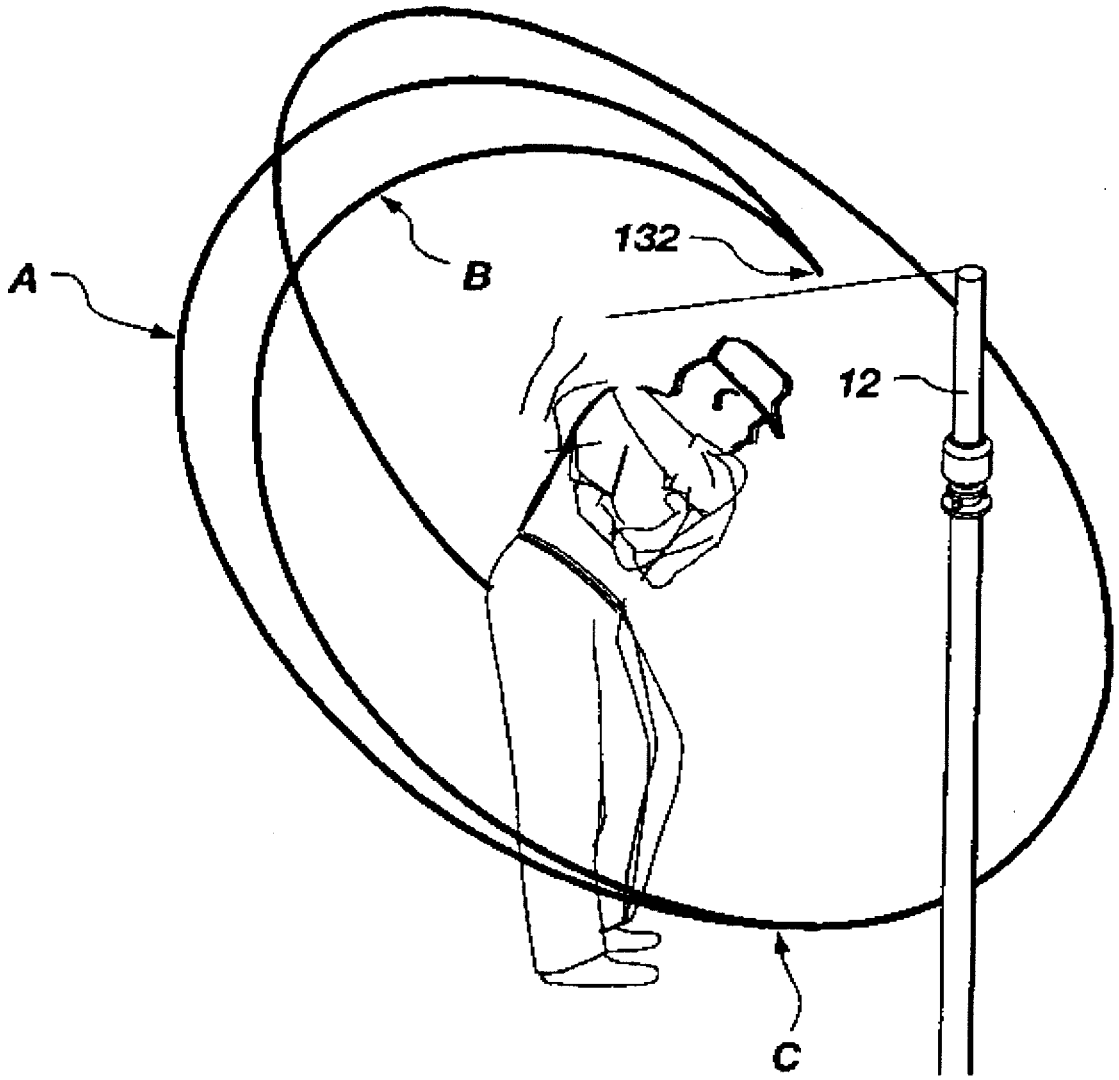

It is particularly important to note that the club head sweeps out an arcuate path A in the swing plane on the backswing, but sweeps out a slightly smaller arc B, still within the same swing plane, as the club travels through the downswing—or what is often called the transition phase. This principle of club movement within the swing plane is illustrated in FIG. 8. The smaller arc B swept out on the downswing results from the hips rotating toward the target and the right ann dropping closer to the body. The smaller arc B of the transition phase must remain within the larger arc A of the backswing, but must also remain within the same swing plane. As can be seen from the illustrations of FIG. 8, the club head will eventually sweep into the original arc of the backswing as the club approaches the ball at point C, and the ball will be properly contacted by the club head.

The present invention maintains the club in the correct swing plane throughout the backswing until the club 70 reaches the apex 132 of the swing. The most critical feature of the invention, however, is the self-adjusting rotation training structure 14, which provides feedback to the user in terms of keeping the club in the swing plane while permitting the club to move correctly through the transition phase. More specifically, as a golfer rotates his body on the downswing through the transition phase, the right arm and right shoulder tend to shift outwardly from the body, thereby throwing the club out of the proper swing plane. The semi-rigidity of the rotation training structure 14 forces the right shoulder and elbow to remain at a proper distance and angle to the body as the downswing is initiated.

Additionally, as the hips rotate and the club handle approaches the hips, there is the tendency to drop the club below the arc of the swing plane, resulting in the club head striking the ground. Indeed, in other golf swing practice devices, the rigidity of the rod (what is termed herein as the rotation training structure 14) drives the arms into the hips and thereby drives the club head into the ground. The automatic length adjusting means 74 of the present invention permits the length of the rotation training structure 14 to shorten or deflect slightly to accommodate the swing of the user's hips and arms, and the club head is permitted to travel correctly within the swing plane and within the arc swept out on the backswing. Consequently, the club head will properly hit the ball and will not be forced into the ground.

The rotatable club attachment collar of the invention is constructed to prevent the user from laying-off the club 70 at the apex 132 of the swing, and at the full extension 136 of the swing, thereby maintaining a consistent movement of the club 70 through the perfect swing plane 130. Laying-off the club, or pointing the club at other than the target, causes the ball to be hit at an angle, or not at all.

Figure 6:
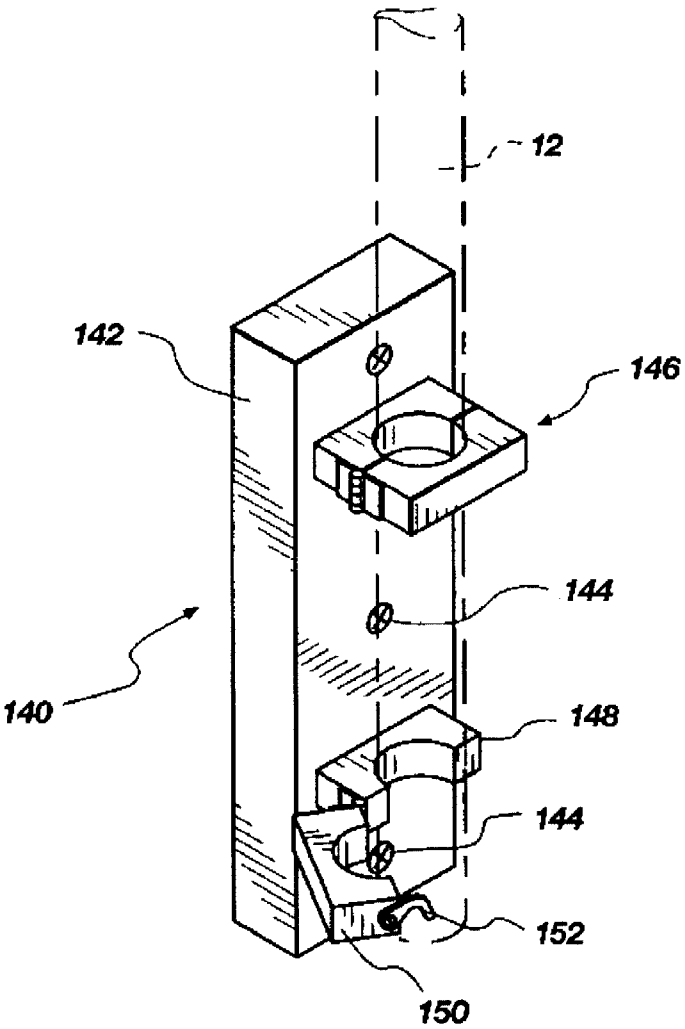
FIG. 6 is a view in perspective of the bracket of the invention illustrating the vertical support structure, in phantom, positioned therein.

The present invention may most conveniently be used outdoors and is structured accordingly. However, a wall bracket 140, as shown in FIG. 6, is provided which permits attachment of the device 10 to an indoor or outdoor vertical surface, such as a wall or fence. The golf swing training device 10 can then be used at all times of the year and at any location—even in areas where a yard area may not be available for setting up the device 10. The wall bracket 140 may generally comprise a flattened board 142 which is positionable against a vertical flat surface and attachment means, such as screws 144 or bolts which extend through the board 142 into the vertical surface. At least one retainer means is provided on the outer facing surface of the flattened board 142 to retain the vertical support structure 12 of the device 10 therein. As illustrated, the retainer means 146 may comprise a first saddle block 148 secured to the outer surface of the flattened board 142 and a second saddle block 150 hingedly connected to the first saddle block such that the first and second saddle block members 148, 150 can be spaced apart a sufficient distance to position the vertical support structure 12 between the facing saddle blocks 148, 150. A locking means 152 may be provided to keep the first saddle block 148 in secure registration with the second saddle block 150, thereby retaining the vertical support structure 12 in the wall bracket.

The present invention is directed to providing a golf swing training apparatus which develops the repeated and consistent movement of a golf club through a perfect swing plane. The present invention provides adjustable means for modifying the vertical orientation of the device to suit the height, body structure and shaft angle preference of an individual user, and provides automatic adjustment means in the rotation training structure of the invention to accommodate the correct arcuate swing through the transition phase of the swing while retaining the club in a perfect swing plane. The present invention also provides means for training the user to achieve a proper address of the ball. The present invention may be modified, however, to meet the specific requirements of the training objective. Hence, reference herein to specific details of the illustrated embodiments is by way of example and not by way of limitation. It will be apparent to those skilled in the art that many additions, deletions and modifications to the illustrated embodiments of the invention may be made without departing from the spirit and scope of the invention as defined by the following claims.

What is claimed is:

1. A golf swing training apparatus comprising:

a longitudinally adjustable vertical support structure;

a rotation training structure pivotally connected to said longitudinally adjustable vertical support structure, said rotation training structure being automatically adjustable in length thereof responsive to the swing profile of a user; and rotatable club attachment collar means positionable about the shaft of a golf club and rotatable coaxially therewith, said rotatable club attachment collar means being pivotally connected to said rotation training structure to provide rotation of said golf club relative to said rotation training structure.

2. The golf swing training apparatus of claim 1 further comprising horizontal guidance structure attached to said longitudinally adjustable vertical support structure to facilitate adopting a correct golf swing stance.

3. The golf swing training apparatus of claim 2 further comprising wall bracket means providing retainer means for retaining said longitudinally adjustable vertical support structure therein, said wall bracket means having securement means for attaching said wall bracket to a vertical support surface.

4. The golf swing training apparatus of claim 1 wherein said longitudinally adjustable vertical support structure further comprises a first member and a second member, said second member being slidably attached to said first member to provide longitudinal adjustment of said vertical support structure.

5. The golf swing training apparatus of claim 4 further comprising locking means positioned between said first member and said second member to retain said first member and said second member in a selected longitudinal position relative to each other.

6. The golf swing training apparatus of claim 5 wherein said first member and said second member are coaxially aligned.

7. The golf swing training apparatus of claim 1 wherein said rotation training structure further includes a length adjustment means providing automatic adjustability of said length of said rotation training structure.

8. The golf swing training apparatus of claim 7 wherein said length adjustment means comprises a spring means positioned within a housing, said housing being pivotally attached at one end thereof to said longitudinally adjustable vertical support structure and pivotally attached at an opposing end to an elongated rod member pivotally secured to said rotatable club attachment collar means.

9. A golf swing training apparatus comprising:

a longitudinally adjustable vertical support structure;

a rotation training structure pivotally connected to said longitudinally adjustable vertical support structure, said rotation training structure being automatically adjustable in length thereof responsive to the swing profile of a user; and rotatable club attachment collar means positionable about the shaft of a golf club and pivotally connected to said rotation training structure to provide rotation of said golf club relative to said rotation training structure, said rotatable club attachment collar means having contact means for preventing laying-off of said golf club during a swing.

10. The golf swing training apparatus of claim 9 wherein said rotatable club attachment collar means includes yoke means for encircling and engaging said shaft of said golf club and a rotatable ring positioned about said yoke means and freely rotatable thereabout.

11. The golf swing training apparatus of claim 9 further comprising length adjusting means connected to said rotation training structure to provide automatic adjustability of said length of said rotation training structure.

12. The golf swing training apparatus of claim 11 wherein said longitudinally adjustable vertical support structure further comprises a first member and a second member slidably connected to said first member, and locking means positioned between said first member and said second member to retain said first member and said second member in a selected longitudinal position relative to each other.

13. The golf swing training apparatus of claim 12 further comprising means for securing said longitudinally adjustable vertical support structure to a horizontal support surface.

14. The golf swing training apparatus of claim 13 wherein said means for securing said longitudinally adjustable vertical support structure to a horizontal support surface includes stake means connected to said first member thereof and at least three anchoring lines secured to said longitudinally adjustable vertical support structure, each said at least three anchoring lines further including stake means for securing said at least three anchoring lines to said horizontal support surface.

15. The golf swing training apparatus of claim 14 further comprising wall bracket means for attaching said longitudinally adjustable vertical support structure to a vertical support surface.

16. The golf swing training apparatus of claim 15 further comprising guidance structure attachable to said longitudinally adjustable vertical support structure for facilitating proper address of a golf ball.

17. A method of perfecting a golf swing comprising the steps of:

providing a golf swing training apparatus comprising a longitudinally adjustable vertical support structure;

a rotation training structure pivotally connected to said longitudinally adjustable vertical support structure, said rotation training structure being automatically adjustable in length thereof responsive to the swing profile of a user; and rotatable club attachment collar means positionable about the shaft of a golf club and coaxially rotatable therewith and pivotally connected to said rotation training structure to provide rotation of said golf club relative to said rotation training structure;

securing said golf swing training apparatus to a support surface;

adjusting said longitudinally adjustable vertical support structure to retain a vertical length sufficient to achieve a parallel alignment of said rotation training structure with the ground when said golf club is positioned at the apex of a backswing;

positioning said rotatable club attachment collar about the shaft of said golf club;

positioning said user in alignment with said longitudinally adjustable vertical support structure; and moving said golf club through the air substantially within a swing plane defined by the arcuate movement of said rotatable club attachment collar means;

rotating said golf club in coaxial rotation with said rotatable club attachment collar means;

rotating said rotation training structure at said pivotal connection relative to said vertical support structure; and maintaining said swing plane through the downswing movement of said golf club by automatic length adjustment of said rotation training structure.

18. The method according to claim 17 wherein said golf swing training apparatus further includes guidance structure for facilitating alignment of said user with said apparatus, and further comprising the step of aligning said user with said guidance structure by positioning the user's feet perpendicular to said guidance structure following said alignment of said user with said longitudinally adjustable vertical support structure.

19. The method according to claim 18 wherein said golf swing training apparatus is secured to the ground by securement means positionable within the ground.

20. The method according to claim 19 wherein said golf swing training apparatus is secured to a vertical support surface by attachment of said longitudinally adjustable vertical support structure to wall bracket means secured to said vertical support surface.

* * * * *